United States Patent [19]

Schmidt

[11] 4,022,103

[45] May 10, 1977

[54] GAS DYNAMIC SABOT STRIPPER

[75] Inventor: Edward M. Schmidt, Forest Hill,, Md.

[73] Assignee: The United States of America as represented by the Secretary of the Army, Washington, D.C.

[22] Filed: Sept. 12, 1975

[21] Appl. No.: 612,886

[52] U.S. Cl. ..... 89/14 SB; 89/14 B; 89/14 D

[51] Int. Cl.[2] ..... F41C 21/18

[58] Field of Search ..... 89/14 R, 14 B, 14 C, 89/14 D, 14 SB; 102/93, DIG. 7

[56] References Cited

UNITED STATES PATENTS

| | | | |
|---|---|---|---|
| 1,259,251 | 3/1918 | Love | 89/14 C |
| 1,773,260 | 8/1930 | Cutts | 89/14 C |
| 2,150,161 | 3/1939 | Green | 89/14 C |
| 2,499,428 | 3/1950 | Tiffany | 89/14 C |
| 3,478,841 | 11/1969 | Hubner | 89/14 D |
| 3,724,320 | 4/1973 | Duke | 89/14 SB |

FOREIGN PATENTS OR APPLICATIONS

| | | | |
|---|---|---|---|
| 6,701 | 1899 | United Kingdom | 89/14 C |
| 812,680 | 5/1937 | France | 89/14 C |

*Primary Examiner*—Stephen C. Bentley
*Attorney, Agent, or Firm*—Nathan Edelberg; Robert P. Gibson; Saul Elbaum

[57] ABSTRACT

A sabot stripper for stripping a sabot within its confines without rotational forces or mechanical contact, having a gas restricting chamber of a uniform diameter greater than the bore diameter of a weapon, connected to the bore of the weapon by a transition chamber of increasing cross-sectional diameter from the bore to the gas restricting chamber.

8 Claims, 16 Drawing Figures

GAS DYNAMIC SABOT STRIPPER

The invention described herein may be manufactured, used and licensed by or for the U.S. Government for governmental purposes without the payment to me of any royalty thereon.

BACKGROUND OF THE INVENTION

1. Field of the Invention

This invention relates generally to sabot strippers and more specifically to a gas- dynamic, non-rotational sabot stripper.

2. Description of the Prior Art

Current techniques to separate sabot components from the flight vehicle consist of mechanical stripping, muzzle jet gas-dynamic discard, freeflight gas-dynamic discard and spin discard. These techniques are illustrated schematically in FIGS. 1–4, respectively.

A mechanical stripper 10, as illustrated in FIGS. 1 and 1A has been used in the launch of a sabot encapsulated flechette round 12 from a small caliber (5.56mm) rifle. The stripper is a subcaliber set of keys or blades 14 located in the gun tube near the muzzle. The keys fracture the plastic or fiberglass sabot and may impart spin or lateral motion to the sabot components. The major difficulty with this technique is the adverse loadings imparted to the flight vehicle. These loadings can effect subsequent projectile motion and, through this, weapon accuracy and dispersion. Additionally, direct contact between the flight vehicle and the stripper keys can cause severe damage to the projectile integrity.

The next two techniques, as illustrated in FIGS. 2 and 3, are similar in that gas-dynamic loadings are used to bring about sabot separation and discard. They differ in the source of these loadings. One technique uses expanding propellant gas energy, while the other uses free air loads on the moving sabot components. Muzzle jet gas-dynamic discard uses the loads applied to the rear surfaces 16 of the sabot components 18 by the propellant gas to cause lateral acceleration of the components as illustrated in FIG. 2. At this point, it should be noted that when the propellant gases are permitted to expand freely from the muzzle of the gun, the gas energy is deposited over a wide area which increases geometrically with separation from the muzzle, as illustrated in FIGS. 2–4 by the arrows and dotted line. Thus, in current bare muzzle applications, propellant gas loadings decrease extremely rapidly such that, within four to five calibers of projectile travel, they are negligible. This limits the use of this source of discard energy to the separation of lightweight, e.g. plastic or rubber, sabot materiel.

Free flight gas-dynamic discard is widely used with fin stabilized projectiles. The technique, as illustrated in FIG. 3, makes use of aerodynamic loadings on the forward surfaces 20 of sabot components 22 to bring about lateral motion.

The final separation technique considered is spin or centrifugal discard. This technique, shown in FIG. 4, is applied to the discard of sabots from spin stabilized projectiles. Upon release from the muzzle of the gun, centrifugal forces destroy the structural integrity of the sabot 24 and cause the components to move away from the flight vehicle.

In general, all of the techniques mentioned rely upon aerodynamic drag to cause the sabot components to drop behind the flight vehicle as they move downrange.

However, if sufficient lateral separation of sabot components may be generated near the muzzle of the gun, it would be possible to interdict sabot components through the use of deflectors or baffle plates. U.S. Pat. No. 3,533,325 is an example of use of a conical deflector to shred the sabot components, which were stripped using a combined mechanical and centrifugal force stripper.

The stripper of the present invention controls propellant gas expansion such that gas energy is concentrated in the vicinity of the projectile. This energy is then used to perform useful work in separating the sabot components from the flight vehicle. The advantage of this technique over mechanical stripping is the elimination of direct mechanical impingement between the stripper and the projectile. When compared to the bare muzzle jet gas-dynamic discard technique of FIG. 2, the current concept increases both the magnitude and duration of propellant gas loadings upon sabot components. The magnitude of loading is controlled by the channel expansion ratio, and the duration of loading is controlled by the length of the channel.

The gas-dynamic stripper technique will permit increased separation of dense sabot materials, e.g., aluminum and steel, and total discard of lighter materials, e.g., plastic and rubber. The increased rate of discard provides for a decreased time of residency of sabot components within the vicinity of the flight vehicle. This in turn decreases the interactions between sabot components and the flight vehicle. Obviously, this effect is advantageous in comparison to the longer residencies encountered with free flight gas-dynamic discard of FIG. 3. Comparison of the proposed technique with spin discard of FIG. 4 shows that similar discard properties may be achieved; however, since fin stabilized rounds are generally not spun at launch or only slowly spun, the use of gas-dynamic sabot stripping is uniquely suited to these rounds.

SUMMARY OF THE INVENTION

The present invention is a gas-dynamic stripper attached to a weapon muzzle to increase the weapon bore diameter from the muzzle value $D_1$ to a greater value, $D_2$, selected to produce optimal gas-dynamic loads on the sabot components. When the projectile leaves the muzzle of the gun, lateral constraints are removed from the sabot components and the high pressure propellant gases expand around the projectile and into the gas-dynamic stripper. By using a chamber of increasing cross-sectional diameter and a chamber of uniform cross-sectional diameter in tandem, a high pressure, high velocity gas flow, which generates large gas-dynamic forces on the projectile and sabot, is maintained throughout the entire length of the stripper. The length of the tandem chambers are selected as a function of the diameters $D_1$, $D_2$, the sabot material, propellant gas, etc., to provide the optimum gas-dynamic forces. The sabot is thereby separated from the projectile within the stripper without rotational forces or mechanical scoring. A deflector or baffle may be provided to deflect and decelerate the sabot components while permitting the projectile to pass through its center.

OBJECTS OF THE INVENTION

An object of the present invention is to provide a sabot stripper which increases the rate of lateral separation of sabot components near the muzzle of the weapon.

Another object of the invention is to diminish the time in which sabot components may interfere with the free flight of the projectile.

A further object of the invention is to increase the rate of lateral separation of the sabot components near the muzzle of the weapon so as to permit deflection and deceleration of the sabot components near the muzzle.

Still another object is to provide sabot stripping by controlling the expansion of propellant gases exiting from the muzzle of a weapon.

A still further object of the present invention is to produce a high pressure, high frequency gas flow which generates large gas-dynamic forces on the projectile and its sabot.

Other objects, advantages and novel features of the present invention will become apparent from the following detailed description of the invention when considered in conjunction with the accompanying drawings.

BRIEF DESCRIPTION OF PREFERRED EMBODIMENTS

Figure 1:
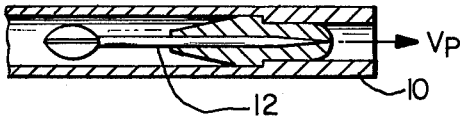
FIG. 1 is a sectional view of a mechanical sabot stripper of the prior art.
Figure 1A:
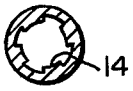
PRIOR ART FIG. 1A
FIG. 1A is a cross-section of the mechanical stripper of FIG. 1.
Figure 2:
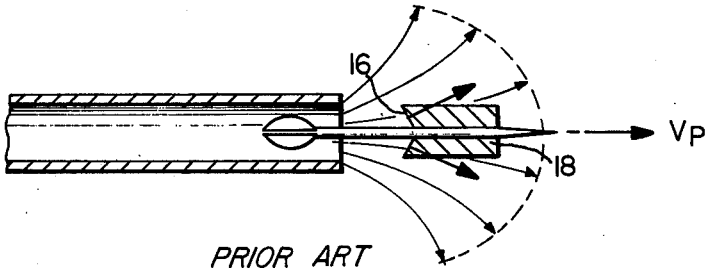
PRIOR ART FIG. 2
FIG. 2 is a schematic of the jet gas-dynamic sabot stripping technique of the prior art.
Figure 3:
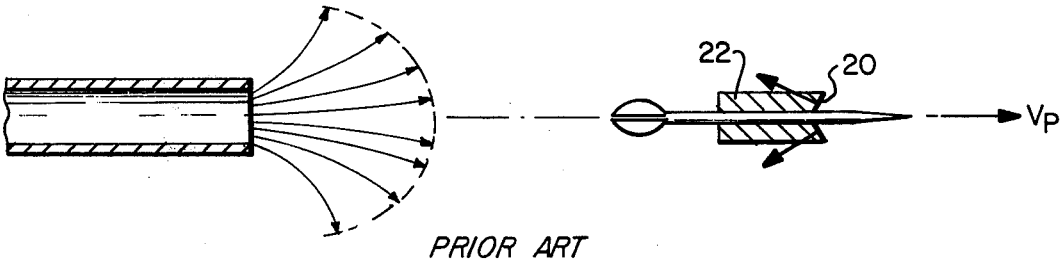
PRIOR ART FIG. 3
FIG. 3 is a schematic view of the freeflight gas-dynamic sabot stripping technique of the prior art.
Figure 4:
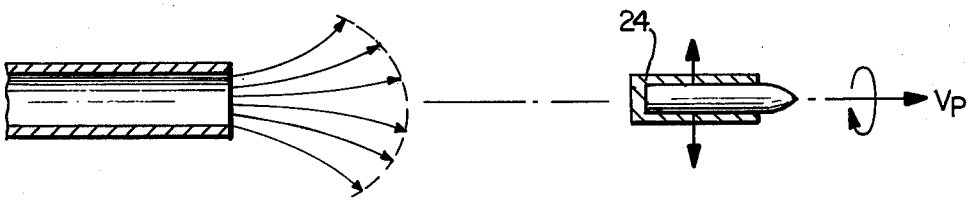
PRIOR ART FIG. 4
FIG. 4 is a schematic view of the centrifugal or spin sabot stripping technique of the prior art.
Figure 5:
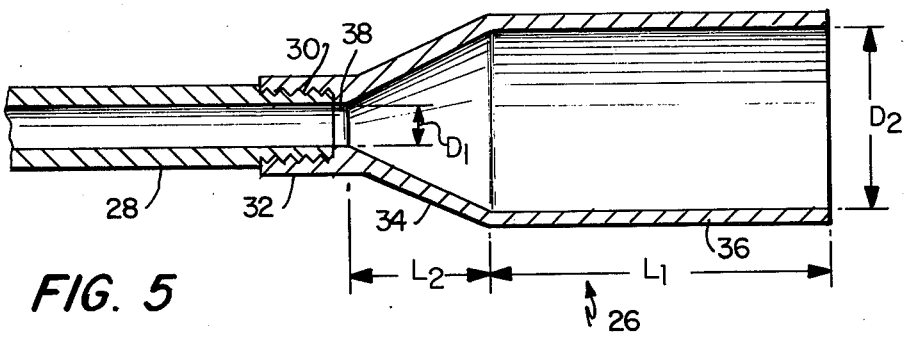
FIG. 5 is a side cross-sectional view of a preferred embodiment the gas-dynamic sabot stripper of the present invention.

As illustrated in FIG. 5, the preferred embodiment of the gas-dynamic sabot stripper of the present invention 26 is shown mounted to the barrel 28 of a weapon by threaded portions 30. Although the gas-dynamic sabot stripper 26 is shown mounted by threaded portions 30, it should be noted that the stripper may be mounted by any other well known means, including welding, clips, bayonet arrangement or any other connecting devices which are well known to the prior art. The gas-dynamic sabot stripper of the present invention has generally three sequential (or tandem) sections, namely, adapter section 32, transition section or chamber 34 and gas-restricting section or chamber 36.

The ratio of the diameter $D_2$ of the gas restricting section to the diameter $D_1$ of the muzzle bore and the length $L_2$ of the transition section and $L_1$ of the gas restriction section, are selected to produce a high pressure, high frequency gas flow which generates large dynamic forces on the projectile and the sabot so as to remove and separate the sabot from the projectile within the confines of the gas-dynamic stripper 26.

The transition section or chamber 34 provides a dynamic transition from the diameter $D_1$ of the muzzle bore to the diameter $D_2$ of the gas restricting section. The section 34 illustrated as a chamber in FIG. 5 is a generically conical or frustro-conical section. Though section 34 is shown as conical, contoured or other curved sections could also be used. Although the length $L_1$ of the transition section 34 is significantly shorter than the length $L_2$ of the gas restricting section 36, elimination of the transition section 34 is undesirable. To eliminate transition section 34 produces a sharp corner whose gas flow adversely affects the separation forces on the sabot and the gas flow in gas restricting chamber 36.

Adapter section 32 is shown having a short interior section 38 extending past the muzzle 28 and connected to transition section 34. This section 38 has a diameter at least as large as the diameter $D_1$ of the muzzle and has a substantially smooth surface so as not to produce any rotational forces on the projectile or the sabot. Since the interior section 38 has no dynamic function, it may be totally eliminated such that the transition section 34 begins immediately at the edge of the muzzle 28.

Figure 6:
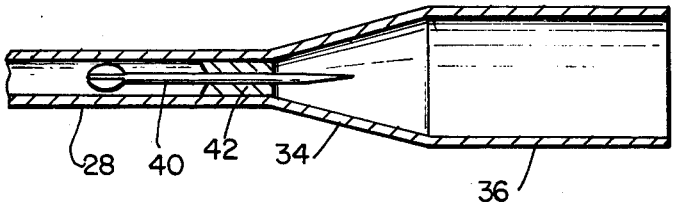
FIGS. 6–10 are schematic sequential views of the present invention stripping a sabot from a projectile.
Figure 7:
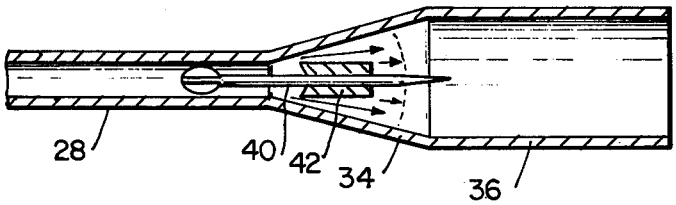
Figure 8:
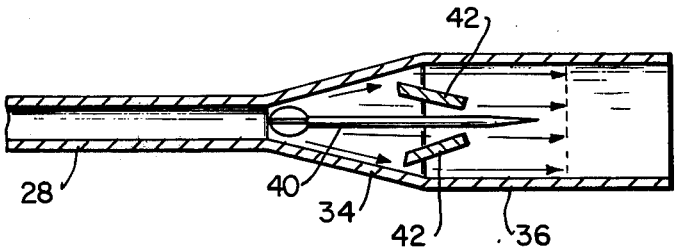

The mechanics of the operation of the gas-dynamic sabot stripper is illustrated in FIG. 6–10. A projectile 40 having a sabot 42 secured thereto is shown in FIG. 6 as about to enter the gas-dynamic sabot stripper of the present invention. At this point, the total force of the propellant gases are exerted on the rear portion of the sabot moving the sabot 42 and the projectile 40 laterally to the right in FIG. 6. Since the sabot is essentially round and equal (in diameter) to the inside diameter of the muzzle, the sabot cannot expand or separate from the projectile 40 within the muzzle bore. When the sabot 42 exits the muzzle bore, the physical radial restraints are removed from the sabot components and the high pressure propellant gas expands around the projectile as shown in FIG. 7. By the time the sabot 42 begins to leave transition section 34 and enter gas restriction section 46, the sabot components 42 begin to separate from the projectile 40. As illustrated in FIG. 8, the section 36 maintains and restricts the high velocity, high density gas flow so as to increase the dynamic load on the sabot and reduce the time of separation of the sabot components from the projectile. It should be noted that the dotted lines in FIGS. 7–10 represent the leading edge of the gas flow, with the arrows representing the direction and dispersion of the gas flow.

Figure 9:
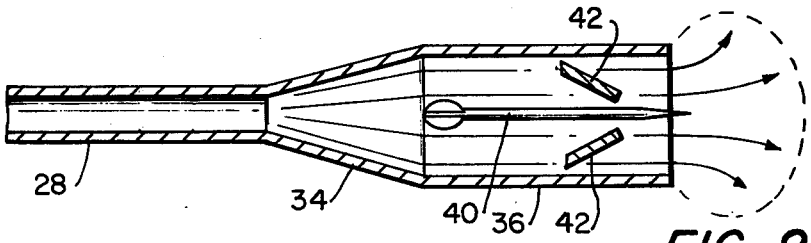
Figure 10:
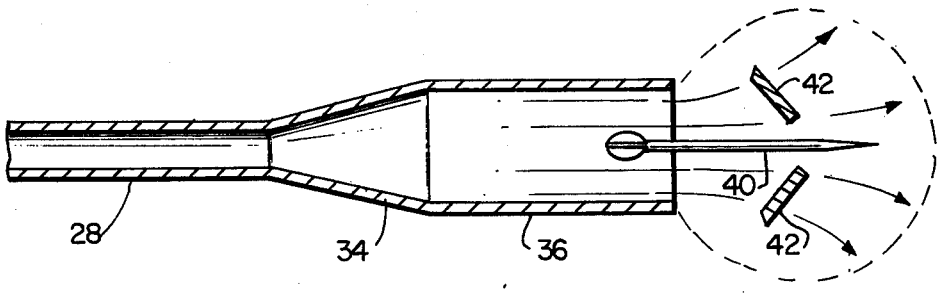

As illustrated in FIG. 9, the gas flow essentially precedes the sabot portions 42 exterior to the gas restricting chamber 36 and disperses in a mushroom-shape gas field. By the time the sabot components 42 exit the gas restricting chamber 36, the mushroom or balloon shape of the gas flow allows the components to have a radial component generally perpendicular to the lateral motion of the projectile 40. Thus, the gas dynamic sabot stripper of the present invention is of sufficient length so as to provide separation of the sabot components 42 from projectile 40 within its confines in a minimum amount of time without scoring or rotational forces.

The ratio of the muzzle bore diameter $D_1$ to the gas restricting chamber diameter $D_2$ may be in the range of 1:1.25 to 1:2.75, though an optimum value is considered 1:2. Similarly, the range of values for $L_2$ may be 0 to $2D_1$ and $L_1$ may be $2D_1$ to $20D_1$. The length $L_2$ of the transition section 34 is a function of the diameter ratios and the contour of section 34. The ratio of the diameter and the length $L_1$ of gas restricting section 36 are a function of the sabot material, propellant gas property variations with respect to time, allowable weight and other parameters for a specific application. The gas dynamic flow produced by the present gas dynamic sabot stripper allows the use and separation of dense sabot materials, for example, aluminum and steel, as well as total discard of lighter materials such as plastic and rubber.

Figure 12A:
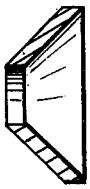
FIGS. 12A–12D are cross-sectional views of modified sabot component deflectors.
Figure 12B:
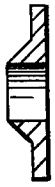
Figure 12C:
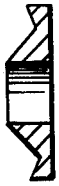
Figure 12D:
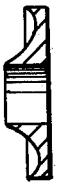
Figure 11:
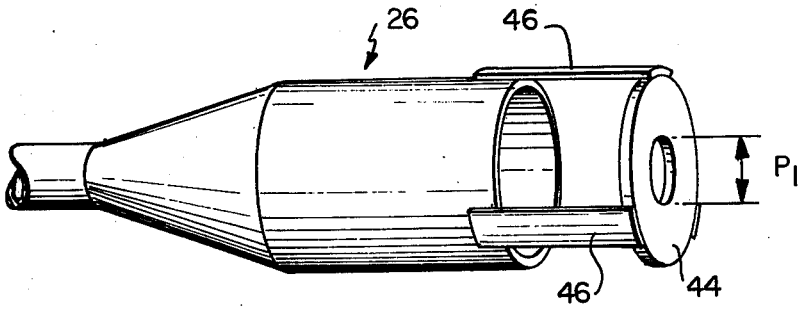
FIG. 11 is a perspective view of the gas-dynamic sabot stripper of the present invention with a sabot component deflector.

Since the present gas dynamic stripper provides complete separation of the sabot components from the projectile in the immediate vicinity of the muzzle, a deflector or baffle may be mounted to the gas dynamic stripper to deflect and decelerate the sabot components while permitting the projectile to pass through its center. As illustrated in FIG. 11, a deflector 44 is connected to the gas dynamic stripper 26 by element 46. The deflector 44 is spaced from the end of the gas dynamic stripper 26 and extends across the total diameter $D_2$ of gas restricting chamber 36. The deflector 44 has a diameter $P_1$ in the center thereof which is aligned with and equal to the diameter $D_1$ of the muzzle bore. The sabot components 42 which exit gas restriction chamber 36 collide with deflector 42 and are thereby decelerated and deflected from their lateral path. In this manner, troop safety is provided and sabot component collection or safe disposal of sabot components is made possible. Other than the disc-shaped deflector 44 of FIG. 11, various other shaped deflectors may be provided having a center aperture therein for the passage of the projectile while deflecting and decelerating sabot components. FIG. 12A shows a deflector having a generally conical shape whereas FIG. 12B features a combination of the conical shape of FIG. 12A and the disc-shape of FIG. 11. FIG. 12C is a variation of FIG. 12B providing a rearward deflecting surface at the end of the conical section. FIG. 12D illustrates a contour rearward deflecting surface at the end of the conical surface which provides a more controlled deflection of the gas stream. The use of any of the deflectors or baffles of FIGS. 11 and 12A–12D is made possible by the reduced time of separation of the sabot from the projectile within the immediate vicinity of the muzzle.

From the preceding description of the preferred embodiments, it is evident that the objects of the invention are attained to provide a gas-dynamic stripper to control the expansion of gases from the muzzle of the weapon and constrain the muzzle gas energy to remain in the vicinity of the projectile axis. The specific interior geometric details of the gas-dynamic stripper may vary with the particular application and may include elliptical, square, rectangular and other non-circular cross-sections. I wish it to be understood that I do not desire to be limited to the exact details of construction shown and described, for obvious modifications can be made by a person skilled in the art.

What is claimed:

1. A muzzle gas dynamic sabot stripper for increasing the muzzle gas dynamic forces on the rear surfaces of a sabot following the exit of said sabot from the muzzle bore of a weapon to which said stripper is attached in order to laterally separate sabot components from a projectile, said stripper comprising:

a gas restricting chamber of first length having a uniform cross-section along its length of a second diameter greater than the diameter of said bore for limiting muzzle gas expansion and directing the muzzle gas axially to increase the dynamic load on the rear of said sabot;

transition chamber means of a second length shorter than said first length connecting one end of said gas restricting chamber to said bore, said transition chamber having a cross-section progressively varying along its length from a diameter at least as large as said bore diameter to a diameter equal to said second diameter for providing a smooth flow transition between said bore and said gas restricting chamber, the other end of said gas restricting chamber being open and of said second diameter;

a deflector having a central aperture coaxial with said bore, said deflector extending across said gas restricting chamber's cross-section to reduce the velocity of said sabot components laterally separated from said projectile; and connecting means connecting said deflector to said gas restricting chamber to support said deflector spaced from the open end of said restricting chamber and to provide muzzle gas flow through said restricting chamber unrestricted by said deflector;

said gas restricting chamber being of sufficient length and diameter to strip a sabot by muzzle gas dynamic forces within said gas restricting chamber without scoring or rotational forces.

2. The gas dynamic sabot stripper of claim 1 wherein the ratio of said first gas diameter to said second diameter is in the range of 1:1.25 to 1:2.75.

3. The gas dynamic sabot stripper of claim 2 wherein said ratio is 1:2.

4. The gas dynamic sabot stripper of claim 1 wherein said first length is from 2 to 20 times said first diameter.

5. The gas dynamic sabot stripper of claim 4 wherein said second length is 2 or less times said first diameter.

6. The gas dynamic sabot stripper of claim 1 wherein said transition chamber is a frustroconical section.

7. The gas dynamic sabot stripper of claim 1 including an adapter chamber of uniform cross-section of said first diameter along its length connecting said bore to said transition chamber, said adapter chamber having a substantially smooth interior surface.

8. The gas dynamic sabot stripper of claim 1 wherein said aperture has a diameter equal to said first diameter.

* * * * *